US006592423B1

(12) United States Patent
Boyle et al.

(10) Patent No.: US 6,592,423 B1
(45) Date of Patent: Jul. 15, 2003

(54) ROTATING HOLOGRAPHIC TOY

(75) Inventors: Brendan Boyle, Palo Alto, CA (US); Jeff Grant, Menlo Park, CA (US); Alex Coriano, Mountain View, CA (US); Adam Skaates, San Francisco, CA (US); Peter Finn, Los Gatos, CA (US); Jacob Olefsky, Palo Alto, CA (US); Chris Countryman, Menlo Park, CA (US)

(73) Assignee: S.R. Mickelberg Company, Jenkintown, PA (US)

( * ) Notice: Subject to any disclaimer, the term of this patent is extended or adjusted under 35 U.S.C. 154(b) by 0 days.

(21) Appl. No.: 10/254,902

(22) Filed: Sep. 25, 2002

(51) Int. Cl.[7] ..... A63H 30/00

(52) U.S. Cl. ..... 446/175; 446/242; 40/414; 40/432; 362/35; 362/323

(58) Field of Search ..... 446/71, 72, 175, 446/219, 236, 238, 242, 243, 241, 244, 484; 40/411, 414, 431, 432; 362/35, 287, 282, 284, 322, 323, 324

(56) References Cited

U.S. PATENT DOCUMENTS 4,097,917 A * 6/1978 McCaslin ..... 362/32
4,304,064 A 12/1981 Kulesza et al.
4,435,917 A 3/1984 Lee
4,552,542 A 11/1985 Reysman
4,852,283 A * 8/1989 Teng ..... 40/426
5,453,036 A 9/1995 Wisznia
5,863,235 A 1/1999 Bendik, Jr. et al.
6,018,899 A * 2/2000 Hanitz ..... 40/473
6,183,336 B1 * 2/2001 Coleman et al. ..... 446/267
6,227,929 B1 5/2001 Nelson et al.

FOREIGN PATENT DOCUMENTS

GB 2221626 * 2/1990

* cited by examiner

*Primary Examiner*—Jacob K. Ackun
*Assistant Examiner*—Jamila Williams
(74) *Attorney, Agent, or Firm*—Caesar, Rivise, Bernstein, Cohen & Pokotilow, Ltd.

(57) ABSTRACT

A toy for producing a three dimensional aesthetically pleasing illuminated image. The toy includes a handle, a light source, a rotary drive mechanism, and a plate-like member having an outer surface at least a portion of which is a holographic diffraction surface. The plate-like member is arranged to be rotated about a longitudinal axis so that light received by the holographic diffraction surface produces an aesthetically pleasing illuminated three-dimensional image. The plate-like member can be mounted so that it moves along the axis with respect to the handle as it is rotated and can include a transparent sphere containing a three dimensional object, e.g., a cartoon character, therein.

28 Claims, 9 Drawing Sheets

32
28C 28B
120
28
30
28A
78D
24
76
116
114
40
20
40
104
22B
52
54
22A
34
22
44
46
42
42
32

FIG.3
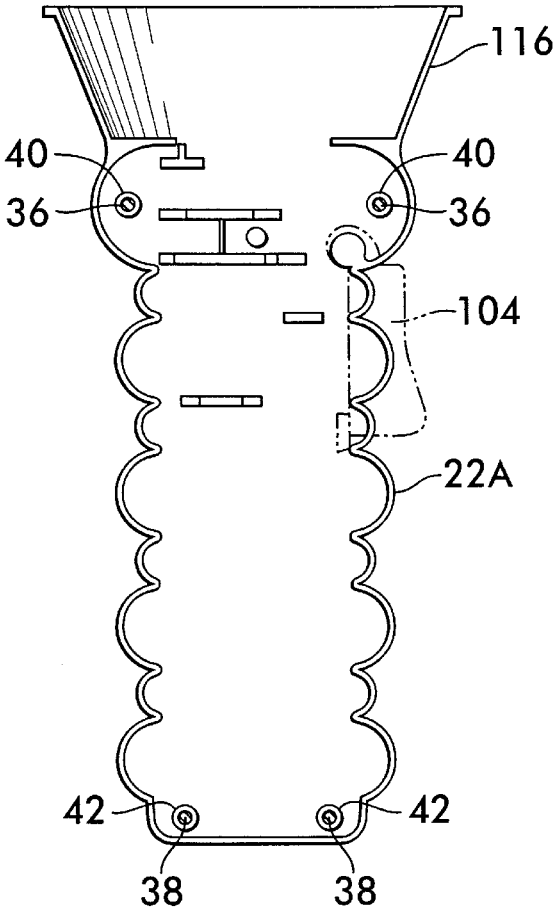
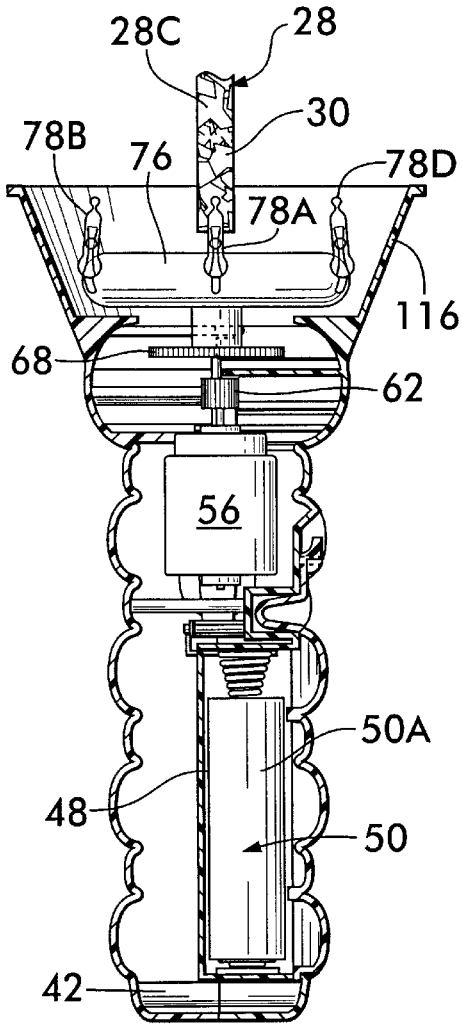
FIG.4

FIG.5
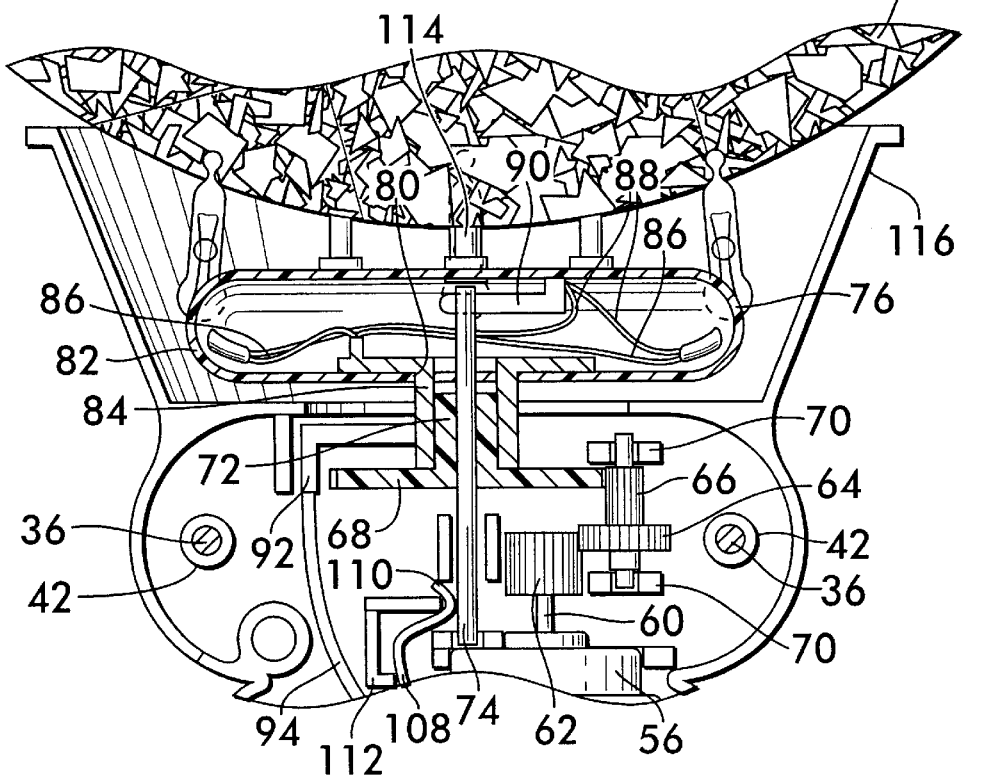
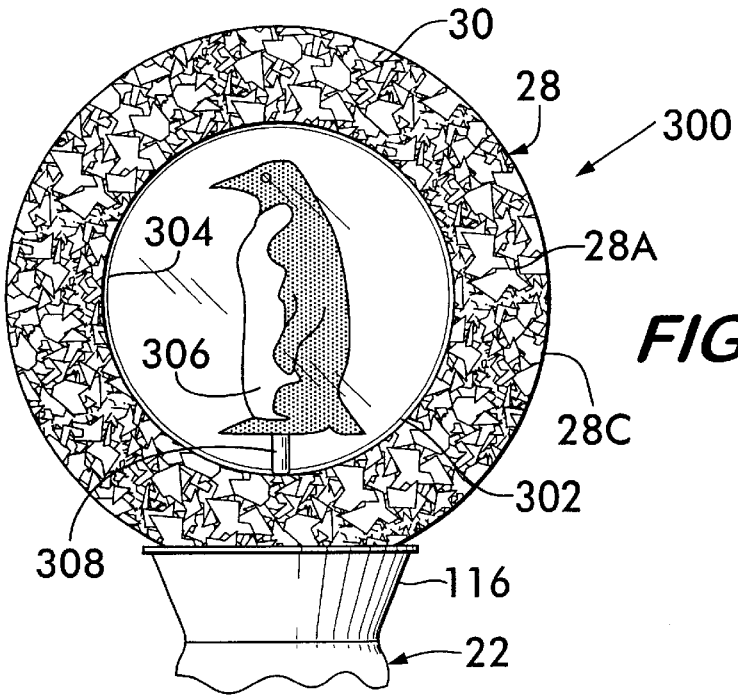
FIG.13

FIG.6
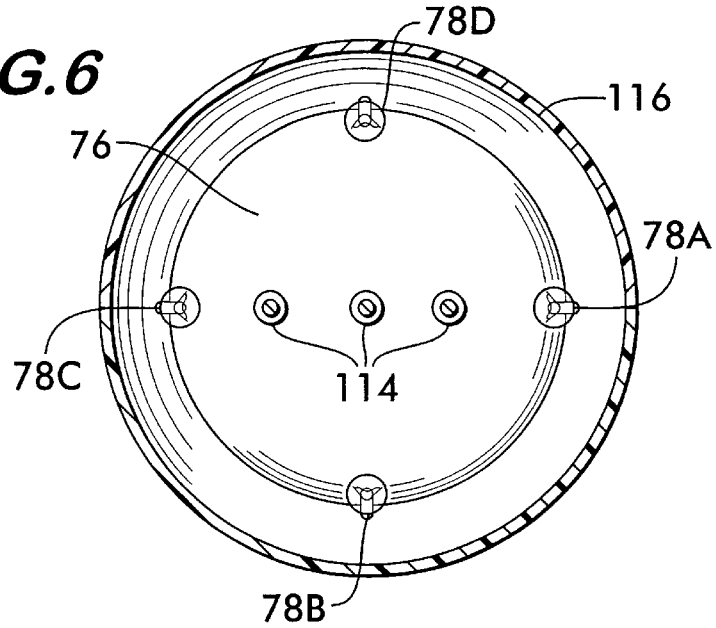
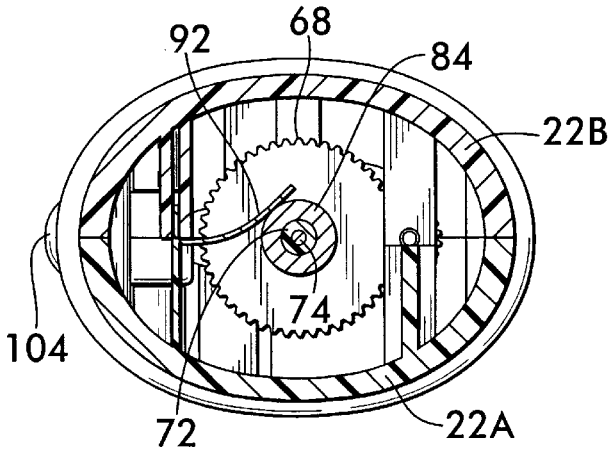
FIG.7
FIG.8
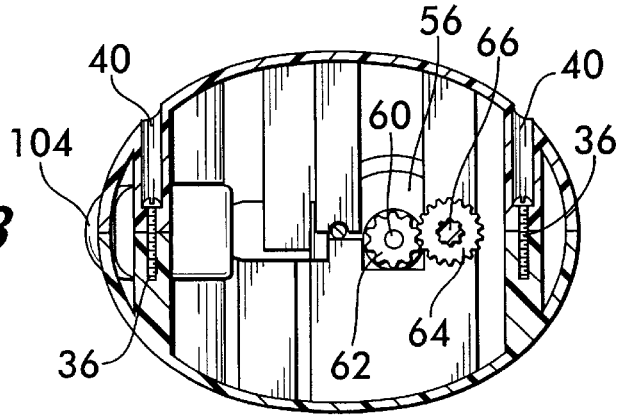

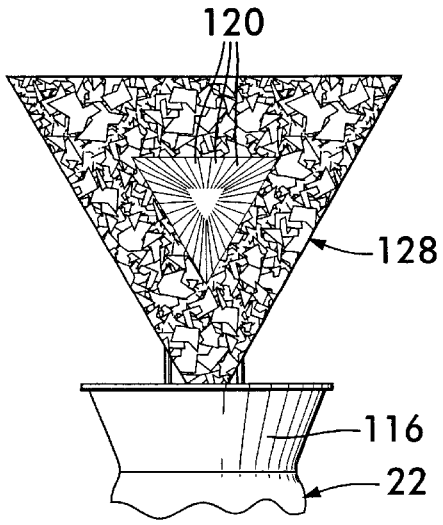
FIG.9
FIG.10
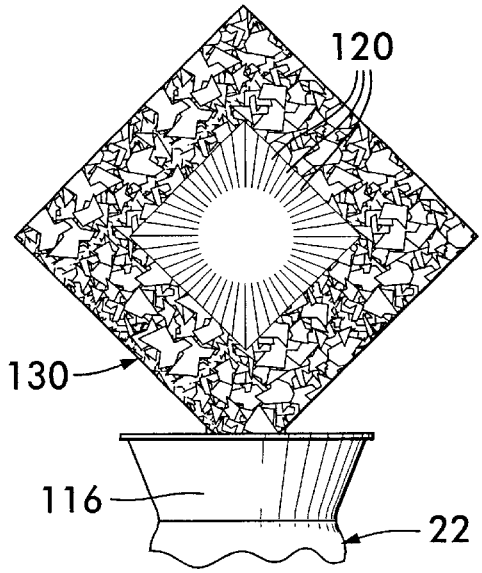
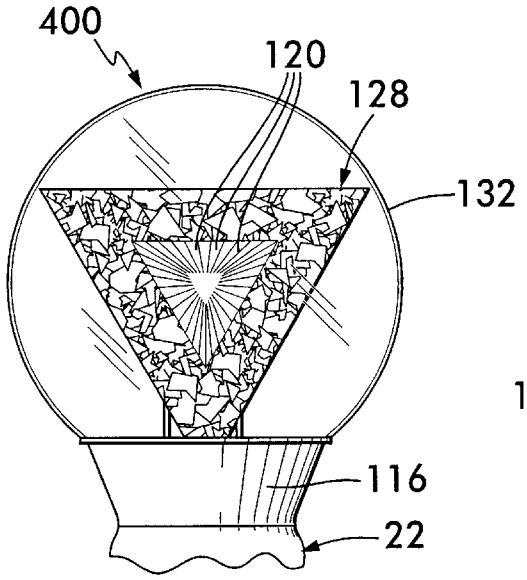
FIG.11
FIG.12
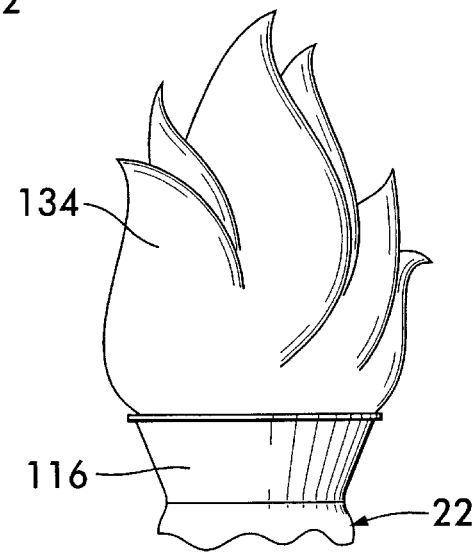

FIG.15
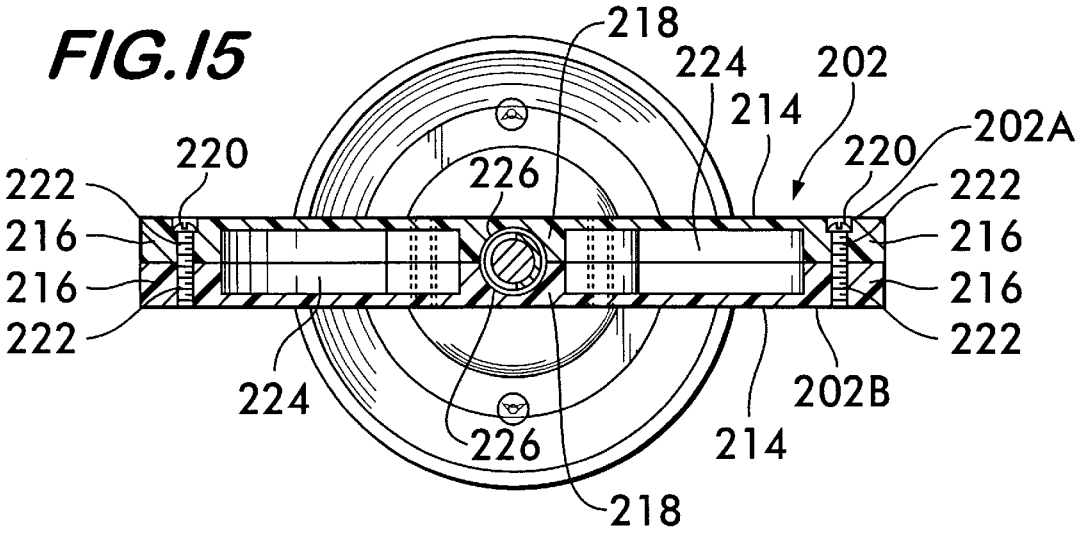
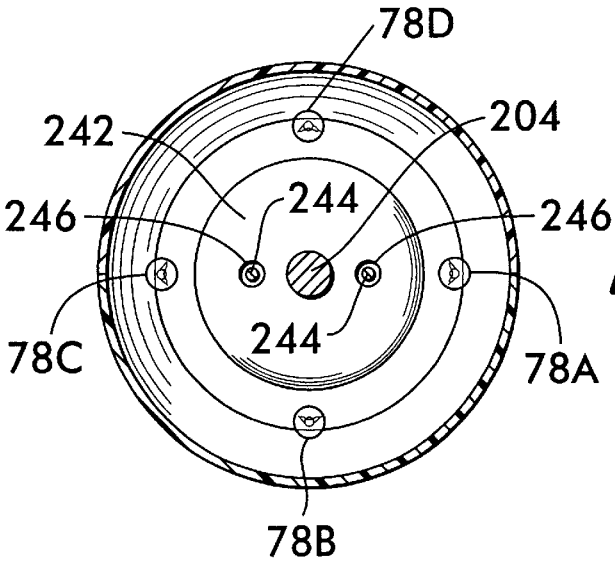
FIG.16

ROTATING HOLOGRAPHIC TOY

BACKGROUND OF THE INVENTION

This invention relates generally to toys, and more particularly, to illuminated spinning toys.

The patent literature includes numerous examples of toys arranged to be spun and/or illuminated to provide an aesthetically pleasing appearance to amuse the user. For example, U.S. Pat. No. 5,453,036 (Wisznia) discloses a one piece spinning toy with markings made of either luminous or fluorescent material. When the toy is spun, it spins at an angle rather than upright, which creates a wobbling effect that causes the markings to generate a clear three-dimensional pattern.

U.S. Pat. No. 6,227,929 (Nelson et al.) discloses an amusement device used to move a supported display object, e.g., an "eyeball" through an erratic path. The amusement device includes a base element in which is disposed a rotating assembly. The rotating assembly can be battery powered, spring powered or manually powered. A support spring is used to interconnect a display object to the rotating assembly in the base element. The support spring has a first end and a second end. The first end of the support spring is coupled to the rotating assembly within the base element, wherein the support spring is rotated by the rotating assembly. The remainder of the support spring extends freely from the base element. The display object is coupled to the second end of the support spring. As the display object rotates, it causes the support spring to at least partially elongate, thereby causing the display object to move erratically from point to point.

U.S. Pat. No. 4,304,064 (Kulesza et al.) discloses a spinning toy or top including a hollow rotating body with a generally low center of gravity caused by a mass positioned near the bottom of the body and having a portion thereof extending through the lower wall of the body to define a point on which the toy spins. A pair of limbs may be pivotally mounted on the top to be raised or otherwise actuated by centrifugal force upon rotation of the top. A head or similar device may be positioned on the body and coupled thereto for concurrent rotation by frictional forces. The toy is spun by a spinner that includes an elongated screw fabricated in a helical configuration. A handle is secured to the top of the screw and a clutch is mounted on the lower end. The clutch includes a gripping member slidably mounted on the screw so as to rotate when moved relative to the screw. The head member includes a detent mechanism so that the head can be held in a stationary position, or selectively stopped by engagement with the handle.

U.S. Pat. No. 4,552,542 (Reysman) discloses an illuminating spinning toy in the form of a disc which may be rotated by twisted cords extending through openings in the disc. The device is formed of two halves which when attached, form an internal battery and light bulb compartment. Within this compartment is located a security bar which may be locked across the compartment to hold the internal elements in a stationary, secure position. A centrifugal switch is also located within the compartment to cause the light to be illuminated when the disc is rotated.

U.S. Pat. No. 4,4355,917 (Lee) discloses an illuminated flying saucer toy is which incandescent lamps are pulsed on and off by an astable multivibrator circuit. The circuit is arranged to pulse at a relatively slow rate when the toy is at rest and at a relatively increased rate when the toy spins at a rate above a predetermined minimum. The increased flash rate is provided through a normally open switch that closes upon rotation of the toy to insert additional resistance into the circuit in parallel with existing resistance thereby to reduce the resistance by which flash interval is determined.

U.S. Pat. No. 5,863,235 (Bendik, Jr. et al.) discloses a cylindrical metal disc that is optimized to spin/roll on a base for an extended length of time, and as the angle of inclination of the disc decreases to zero, a tone is emitted by the spinning/rolling of the disc rises in pitch towards infinity. To optimize the spinning/rolling time, the radius-to-height aspect ratio of the disc is approximately three, the upper surface of the base and the lower edge of the disc are smooth and hard to enable the disc to spin/roll for an extended length of time, and the base has three legs and is solidly constructed to minimize energy losses due to vibration. The upper surface of the base is concave to prevent the disc from wandering as it spins/rolls. The top of the disc is tessellated with tiles having effectively random optic orientations to produce the appearance of a cloud of sparkling lights in the vicinity of the top surface of the disc as it spins/rolls.

Various illuminated spinning toys are commercially available. For example, SRM Toys, the assignee of the subject invention, sells a toy under the trademark "Light Chaser." The Light Chaser toy is a hand-held device including a handle assembly supporting a rotatable hub. Projecting outward from the hub are plural flexible arms, each one terminating in a light source or lamp. The hub is arranged to be rotated at a high rate of speed by a electric motor receiving power from a battery pack. The battery pack and the motor are located in the handle assembly. The handle assembly includes a depressable button or trigger, which when depressed enables electric power from the battery pack to be provided to the motor, whereupon the motor operates to rapidly spin the arms and cause them to extend outward radially from the hub. The lights in the arms are arranged to receive power from the battery pack when the trigger is depressed, whereupon they illuminate as they spin, creating a highly attractive visual effect.

While the foregoing prior art appears generally suitable for their intended purposes, they still leave much to be desired from the standpoints of providing an aesthetically pleasing visual appearance.

SUMMARY OF THE INVENTION

A toy for producing a three dimensional aesthetically pleasing image. The toy comprises a handle, a source of illumination, a rotary drive mechanism, and a plate-like member. The plate-like is rotatable about an axis and has an exterior surface at least a portion of which is a holographic diffraction surface, e.g., the exterior surface includes at least a portion in the form of a holographic diffraction film. The handle is arranged to be held in the hand of a user and serves to hold the rotary drive mechanism therein.

The rotary drive mechanism comprises an electrical power source (e.g., a battery pack including one or more electric batteries), an electrical switch (e.g., an ON-OFF switch), and an electrically operated motor. The motor is coupled to the power source, the switch and the plate-like member. Actuation of the switch causes electrical power provided from the power source to the motor to cause the motor rapidly rotate the plate-like member about the axis. The plate-like member can have any shaped periphery or profile, e.g., be circular, so that when it is rotated it creates the illusion of a three dimensional image, e.g., a sphere, corresponding to the two dimensional profile of the plate-like member. Light received by the holographic diffraction surface on the rotating plate-like member is refracted to produce the visual effect as if the three dimensional image was internally illuminated, e.g., multi-chromatically.

In one exemplary preferred embodiment of the invention the plate like member includes an opening in which there is located a transparent sphere having a three dimensional body, e.g., a cartoon character, disposed therein for viewing through the sphere.

In another exemplary embodiment the rotating plate-like member is mounted on a shaft, with the shaft being coupled to the motor for rotation about the longitudinal axis. In this embodiment the shaft is also movable axially along the axis toward and away from the handle, whereupon the rotating plate-like member appears to levitate with respect to the handle.

DESCRIPTION OF THE DRAWINGS

The features and many of the attendant advantages of this invention will become readily appreciated as the same becomes better understood by reference to the following detailed description, when considered in connection with the accompanying drawing, wherein:

FIG. 3 is a front elevational view of the underside of the removed handle section;

FIG. 4 is a sectional view taken along line 4—4 of FIG. 2;

FIG. 5 is an enlarged view, partially in section, of a portion of the toy shown in FIG. 1;

FIG. 6 is an enlarged sectional view taken along line 6—6 of FIG. 2;

FIG. 7 is an enlarged sectional view taken along line 7—7 of FIG. 2;

FIG. 8 is an enlarged sectional view taken along line 8—8 of FIG. 2;

FIG. 9 is a front elevational view of the toy shown in FIG. 1 but with an alternative embodiment of the rotatable hologram-bearing member;

FIG. 10 is a front elevational view of the toy shown in FIG. 1 but with still another alternative embodiment of the rotatable hologram-bearing member;

FIG. 11 is a front elevational view of the toy shown in FIG. 1 but with still another alternative embodiment of the rotatable hologram-bearing member;

FIG. 12 is a front elevational view of the toy shown in FIG. 1 but with still another alternative embodiment of the rotatable hologram-bearing member;

FIG. 13 is a front elevational view of the toy shown in FIG. 1 but with still another alternative embodiment of the rotatable hologram-bearing member;

FIG. 15 is a sectional view taken along line 15—15 of FIG. 14;

FIG. 16 is a sectional view taken along line 16—16 of FIG. 14;

DETAILED DESCRIPTION OF THE PREFERRED EMBODIMENT

Figure 1:
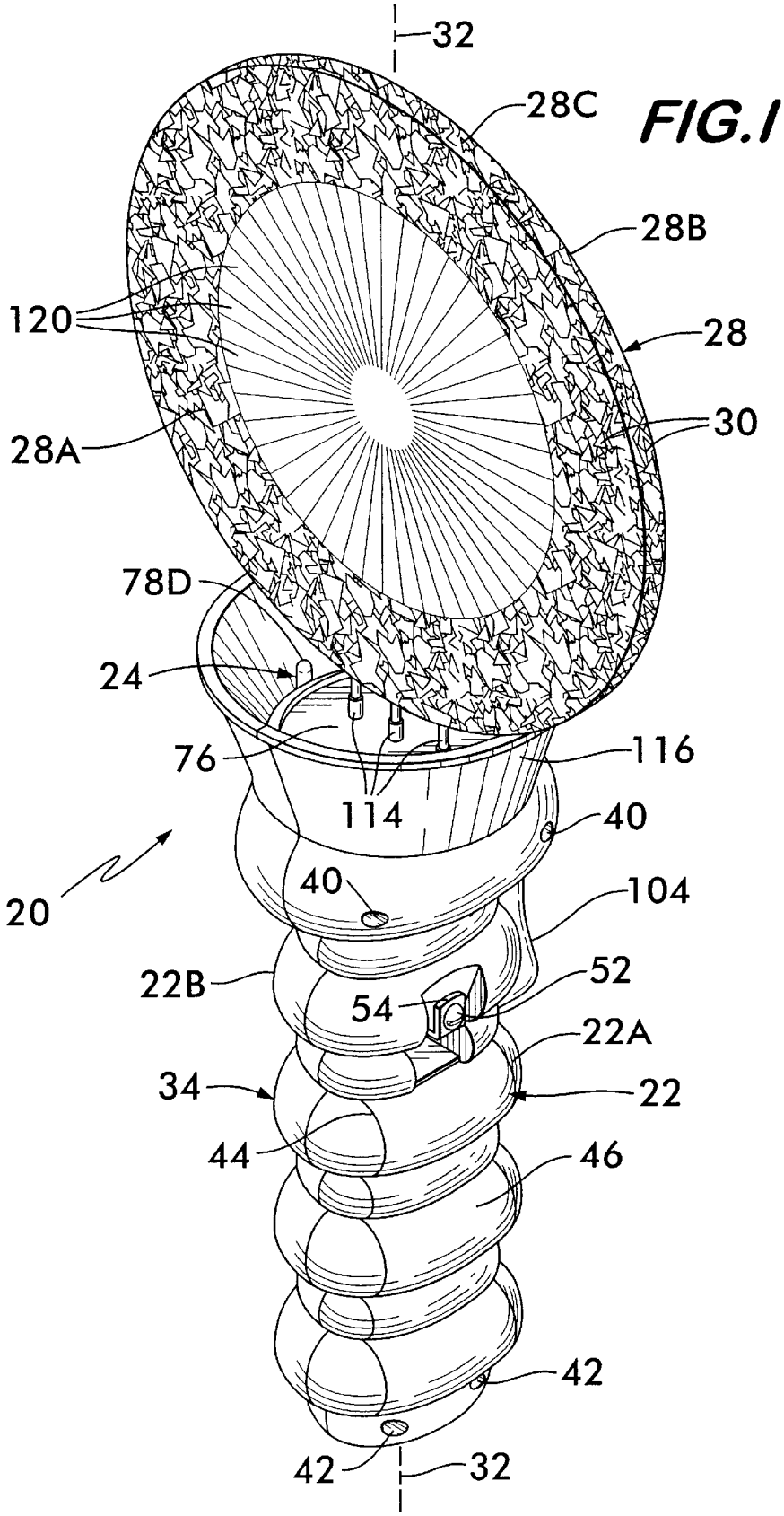
FIG. 1 is an isometric view of one exemplary embodiment of a toy constructed in accordance with this invention having a rotatable member whose exterior surface bears a hologram and which member is arranged to be rotated to provide an aesthetically pleasing appearance.

Referring now in greater detail to the various figures of the drawing, wherein like reference characters refer to like parts, a toy embodying the present invention is generally shown at 20 in FIG. 1.

Figure 2:
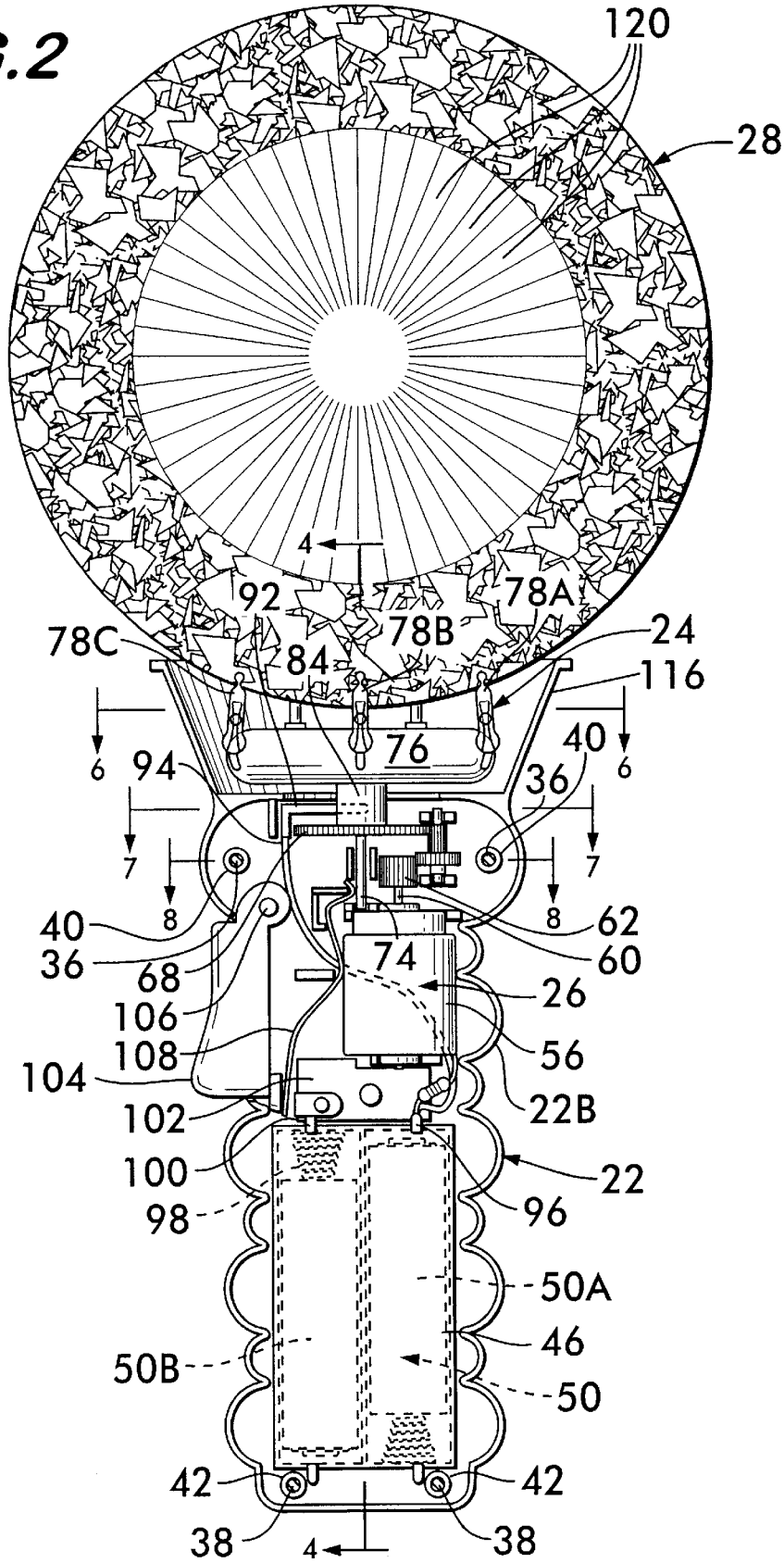
FIG. 2 is a front elevational view, with a portion of the handle section of the toy removed to show the interior construction.

The toy basically comprises a handle assembly 22, an illumination assembly 24 (FIGS. 1 and 2), an electrically operated motor and drive assembly 26 (FIG. 2), and a decorative rotatable member 28. The details of the decorative rotatable member 28 will be described later. Suffice it for now to state that the member 28 is a plate-like member that is generally planar and includes a pair of opposed planar outer surfaces 28A and 28B. In the exemplary embodiment of FIG. 1, the plate-like member 28 is of generally circular shape having a circular peripheral wall 28C. Each of the generally planar surfaces 28A and 28B includes a holographic diffraction film 30 covering at least a portion of that surface. The holographic diffraction film 30 may be either a foil or paper and is adhesively secured on the outer surface (s) of the plate-like member 28. In the embodiment of FIG. 1, the peripheral surface 28C of the plate-like member also includes.a holographic diffraction film 30 covering it. The holographic diffraction film is arranged to refract light in a very interesting and aesthetically pleasing way, e.g., it catches light and reflects it in all directions to give a spectacular light show. In the embodiment shown, which is merely exemplary of a vast multitude of holographic diffraction films that may be used, the visual effect produced is a glistening prismatic or multi-chromatic effect.

The holographic film bearing member 28 is arranged to be rotated about a longitudinal axis 32 of the toy by the motor and drive assembly 26 when that assembly is actuated. The rotation of the plate-like member on its shaft is sufficiently fast so that it produces the illusion of a three dimensional object, e.g., the round disk of FIG. 1 appears as a globe. Moreover, light reaching the rotating plate-like member 28 bounces off its holographic diffraction film-bearing surface to provide the illusion of an internally illuminated, glistening three-dimensional body. In the case of the specific embodiment shown in FIG. 1, the rotating plate-like member will appear as a sparkling, multi-chromatic glistening globe.

The toy 20 is arranged to be held in the hand of a user and operated to rotate the holographic film-bearing plate-like member while so held. To that end, the toy includes the heretofore identified handle assembly 22. The details of that assembly are best seen in FIGS. 1–4 and basically comprise a pair of molded plastic handle elements or half-shells 22A and 22B. The half-shells may be formed of any plastic material and can be of any color or surface appearance. The two half-shells are arranged to be secured together by two pairs of threaded fasteners 36 and 38 (FIG. 3) which extend through two pairs of aligned openings 40 and 42, respectively, in the two half-shells 22A and 22B. When assembled the half-shell members 22A and 22B conjoin with each other to form a handle 34 that is of a bulbous ribbed outer profile. This outer profile is not only aesthetically pleasing, it is comfortable to hold. The handle 34 can of course be formed of other half-shells of other shapes to provide an aesthetically pleasing yet comfortable handle. The handle is arranged to be grasped in the hand of the user and includes a trigger button (to be described later) accessible by a finger of the user to effect the operation of the toy.

As best seen in FIG. 1, the shell member 22A forming one portion of the handle includes an opening 44 in it. The opening is arranged to releasably receive a cover member 46. The cover member is of the same profile as the remainder of the shell 22A of the handle assembly so that when it is in place the ribbed handle 34 is continuous. The cover assembly 46 is removably mounted as part of the handle assembly to provide access to a battery compartment 48 (FIG. 2) that is located within the interior of the handle. The battery compartment is in itself in the form of a hollow, box-like member arranged to receive a pair of conventional, electrical batteries 50A and 50B, e.g., typical "M" cells, to form a battery pack 50. The battery pack 50 forms a portion of the electrically operated motor and drive assembly 26. In particular, the battery provides electrical power to a motor (to be described later) to cause the operation of the motor and to effect the illumination of the illumination assembly 24.

Access to the battery compartment 48 and the battery pack located therein is provided by a removable screw 52 and an associated clip 54. Thus, upon loosening the screw and removing the clip, the battery cover 46 may be removed to provide access to the battery pack 50 in the battery compartment 48.

The motor and drive assembly 26 is also located within the handle assembly 22 and basically comprises a small, electrically operated motor 56 and an associated gear train. The motor 56 includes a rotary output shaft 60. As best seen in FIG. 5, the gear train is made up of a plurality, e.g., four, gears 62, 64, 66 and 68 which are coupled to each other. In particular, as best seen in FIG. 4, a toothed gear 62 is mounted on the rotary output shaft 60 of the motor 56. The gear 62 is arranged to mesh with a toothed gear 64. The gear 64 is fixedly secured to another toothed gear 66 along its axis of rotation and both are mounted in the handle assembly 22, via a pair of support ears 70. The gear 66 is arranged to mesh with a toothed gear 68. The gear 68 includes a central hub portion 72. The central hub portion 72 includes a central passageway through which a rotation shaft 74 extends. The rotation shaft 74 is an elongated rod-like member which extends into a rotary support member 76.

The rotary support member 76 is a hollow member or housing of a generally circular profile when viewed from either the top or bottom. The rotating support member 76 serves as the means for rotatably supporting the decorative rotatable planar member 28 on it. In addition, the support member 76 also serves to mount a plurality of lamps 78A, 78B, 78C and 78D. These lamps will be described later. Suffice for now to state that the lamps 78A–78D make up a portion of the illumination assembly 24 mentioned earlier.

The rotary support member 76 also includes a lower wall 82 having an opening 80 therein. It is through the opening 80 that an electrically conductive flanged hub 84 extends. The flanged hub 84 includes a central passageway surrounding and tightly engaging the upstanding hub 72 of the drive gear 68.

Each of the lamps 78A–78D is mounted at an equidistantly spaced location about the periphery of the rotary support member 76. Each lamp is of a conventional construction and may be of an incandescent filament type or a light emitting diode (LED) type. Electrical power for each of the lamps 78A–78D is provided via a plurality of electrical conductors. To that end, one electrical conductor 86 is electrically connected to one of the poles of each of the lamps 78A–78D and is also connected to the electrically conductive hub 84. The other pole of each of the lamps 78A–78D is connected via a respective electrical conductor 88 to an electrically conductive brush 90. The brush 90 is fixedly mounted within the rotating support member 76. The brush 90 is arranged to be in electrical engagement with the rotating support shaft 74. To that end, both the brush and the support shaft are formed of any suitable electrically conductive material(s). Another electrically conductive brush 92 formed of any suitably electrically conductive material is mounted within the handle assembly 22 and arranged to engage the outer surface of the conductive hub 84. The brush 92 is in turn connected via an electrical conductor 94 to one contact 96 (FIG. 2) of the battery pack 50.

The two batteries 50A and 50B of the battery pack 50 are connected in series with each other and contact 96 serves as the positive pole of that serial connection. The other or negative pole of the serial connected batteries of the battery pack 50 is connected via a helical spring 98 (FIG. 2) to a contact 100 which is fixedly mounted on a support block 102. The support block 102 forms a portion of the handle assembly.

Energization of the electric motor 56 from the battery pack 50 to effect the rotation of the holographic bearing plate-like member 28 and the illumination of the lamp 78A–78D is achieved by means of a depressable trigger button 104. In particular, the handle assembly 22 includes a depressable button or trigger member 104 which is pivotably suspended on a pin 106. The trigger button includes a lower end portion which is arranged when depressed to enable the trigger to pivot about the pin 106. This action engages the lower free end of a leaf spring 108 to thereby bring that portion into engagement with the fixed contact 100 of the battery pack 50. As best seen in FIG. 5, the leaf spring 108 includes at its upper end a curved engagement finger 110 for electrically engaging the rotary drive shaft 74. The leaf spring is held in place by plural projections 112 forming a portion of the handle assembly.

As should be appreciated by those skilled in the art, when the trigger button 104 is depressed, the lower end of the leaf spring 108 is brought into engagement with the fixed contact 100, thereby completing an electrical circuit from the battery pack 50 through the leaf spring 108 and the conductive rotary shaft 74 from whence electrical current flows through the brush 90 to one pole of each of the lamps 78A–78D. The current flows through the lamps to each of the other poles of those lamps and back to the conductive hub 84 where it then flows to the brush 92 and through the conductor 94 back to the other fixed contact 96 of the battery pack 50. Accordingly, the lamps will be illuminated by the batteries of the battery pack. Moreover, the depression of the trigger button 104 to bring the leaf spring 108 into engagement with the contact 100 also effects the electrical energization of the motor 56 via plural electrical conductors (not shown). The energization of the motor 56 causes its rotary output shaft 60 to rotate about its longitudinal axis at a high rate of speed. The associated gears 62–68 of the gear train couple the rotary output of the shaft 60 to the rotary support member 76. Accordingly, depression of the trigger button causes the lamps 78A–78D to illuminate and also causes the rotary support shaft 76 to rotate.

As best seen in FIGS. 1 and 5, the planar panel 28 bearing the hologram on its outer planar surfaces is mounted perpendicularly with respect to the top surface of the rotary support member 76. This is accomplished by three standoffs 114. The lamps 78A–78D are mounted so that they extend upward from the support member and are located adjacent the lower portion of the hologram bearing panel 28.

Since the holographic film-bearing plate-like member 28 is mounted on the support member 76, the plate-like member 28 rotates about the longitudinal axis 32 of the toy when the motor 56 is energized. The illumination provided by the lamps 78A–78D rotating with the support member 76 causes the holographic diffraction film 30 of the plate-like member 28 to produce a distinctive glistening multi-chromatic appearance simulating an internally illuminated three-dimensional globe. If the toy is used in a lighted environment, ambient light reaching the rotating planar panel 28 will provide additional illumination for it.

In order to enhance the illumination of the rotating plate-like member 28 by the lamps 78A–78D the two shells 22A and 22B of the handle assembly include portions which conjoin to form a flared or conically shaped sidewall 116. This conically shaped sidewall is located at the upper end of the handle 34 and surrounding the rotatable support member 76. The sidewall 116 serves to direct the light produced by the lamps 78A–78D and/or the ambient light toward the rotating plate-like member 28. To enhance that reflective effect, the inner surface of the sidewall may include a reflective coating thereon.

It should be pointed out at this juncture that the planar rotatable holographic film-bearing plate-like member 28 shown in FIG. 1 is merely exemplary of a vast number of different shapes and sizes that can be utilized in accordance with this invention. Those members may be of regular geometric shape or irregular shape and may be made to simulate different items, characters and the like. For example, as shown in FIG. 9, the rotating hologram bearing member, i.e., the plate-like member, is of the overall shape of a triangle and is designated by the reference number 128. In FIG. 10 the rotating member is in the form of a diamond and is designated by the reference number 130. In FIG. 11 there is shown an alternative embodiment of a toy 400 constructed in accordance with this invention. The toy 400 is identical to the toy 20 shown in FIG. 9, except that it includes transparent sphere 132 mounted on the lip of the flared sidewall 216 to enclose the rotatable holographic defraction surface bearing plate 128 therein. In FIG. 12 the rotatable member bearing the holographic surface(s) is in the form of an irregular shape, e.g., a flame 134.

In the embodiments of FIGS. 1 and 9–11, the holographic film-bearing plate-like members 28, 128 and 130, respectively, have two distinctive zones. In particular, the central portion of each of those planar members 28, 128 and 130 includes a plurality of wedge-shaped reflective sectors 120. The sectors project outward radially from the center of each of the planar surfaces of the rotatable plate-like member. These plural sectors may be formed of a highly reflective material, e.g., a silver or mirror finish. The portion of the planar outer surface surrounding the sectors forms another zone. In this case, that zone bears the holographic diffraction film 30. In the embodiment shown the holographic diffraction film comprises of a myriad of irregularly shaped and sized areas which produce a prismatic or multi-chromatic light effect when light reaches them. This light may be provided by the rotating lamps 78A–78D and/or the ambient light from the surroundings in which the toy is used or from both places.

In FIG. 13 there is shown still another alternative embodiment of a toy 300 constructed in accordance with this invention. The embodiment of FIG. 13 is similar to that of FIG. 1 except that the central portion of the planar rotatable plate-like member 28 includes a transparent sphere (to be described later) in it. In the interest of brevity, the common elements of toys 300 and 20 will be given the same reference members and the details of their construction and operation will not be reiterated. The rotatable plate-like member has a central opening 302 in which the heretofore mentioned transparent sphere, which is designated by the reference number 304, is located. Located within the transparent sphere 304 is a three-dimensional figure, such as a fanciful character, cartoon figure, animal, etc. The three-dimensional figure is designated by the reference number 306 and in this exemplary embodiment is a penguin. The penguin 306 is mounted on a shaft 308 fixedly secured to the plate-like member 28 at the bottom of the opening 302. In the embodiment of FIG. 13 the penguin FIG. 306 rotates along with the plate-like member 28 so that it appears to be entrapped within the multi-faceted glistening globe produced by the holographic diffraction film 30 of the plate-like member 28 surrounding the sphere 306. The FIG. 306 may be mounted so that it remains stationary as the plate-like member rotates.

Figure 14:
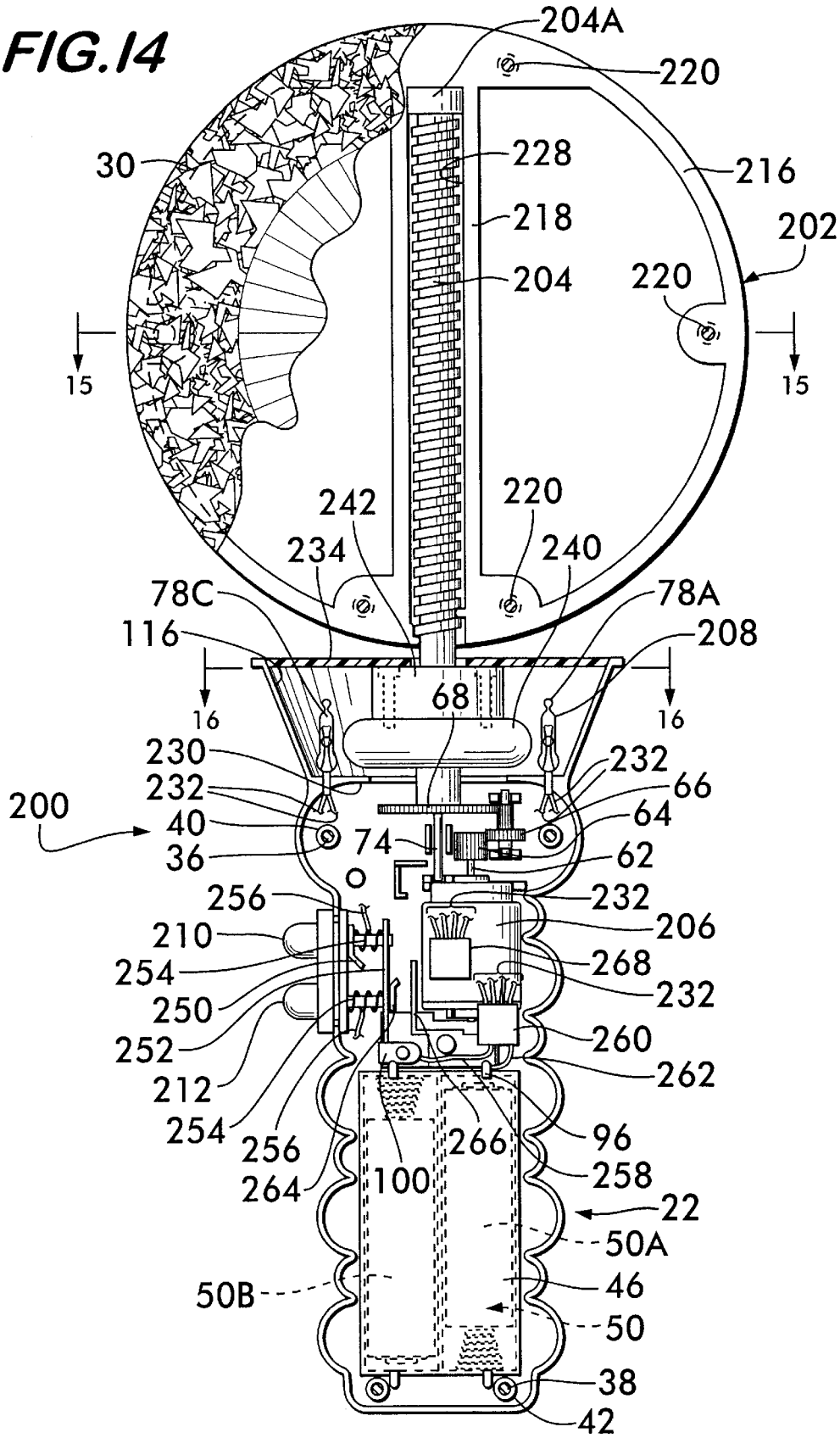
FIG. 14 is a side elevational view of another exemplary embodiment of a toy constructed in accordance with this invention whose rotatable member is arranged to be rotated and levitated from the position as shown to provide an aesthetically pleasing appearance, and with a portion of the handle section of the toy removed to show the interior construction.

In FIG. 14 there is shown another alternative embodiment of a toy 200 constructed in accordance with this invention. In the embodiment 200 of FIG. 14 the rotating holographic film-bearing plate-like member is arranged to not only rotate and be illuminated like that described heretofore, but also to be levitated, that is to rise upward from the handle assembly when one button or trigger of the toy is depressed and to descend or move downward from its elevated position when another button or trigger is depressed. The toy 200 is in many ways similar to the toy 20. Thus, in the interest of brevity the common elements of toys 200 and 20 will be given the same reference numbers and the details of their construction and operation will not be reiterated. Among the different features of toy 200 that are not found in toy 20 are the following: an elevatable/descendable rotating plate-like member 202 whose outer surfaces are holographic diffraction surfaces 30, a drive shaft 204 for effecting the elevation and descent of the plate-like member 202 with respect to the handle assembly 22, a reversible electric motor 206 for effecting the rotation of the drive shaft in either a clockwise or counterclockwise direction, a stationary illumination assembly 208 for illuminating the holographic surfaces of the plate-like member 202, and a pair of triggers 210 and 212 and associated electrical switches and conductors (the details of which will be described later) for providing electric power from the battery pack 50 to the motor 206 in response to depression of the triggers 210 and 212. Depression of the trigger 210 causes the motor to rotate in one direction. Depression of the trigger 212 causes the motor to rotate in the opposite direction (as will be described later).

The details of the plate-like member 202 will now be described with reference to FIGS. 14 and 15. Thus, as can be seen the member 202 is formed of a pair of half-sections 202A and 202B. Each half-section is a generally disk-like member having a generally planar outer surface 214, an annular peripheral wall 216 and a central rib 218 located opposite the outer surface 214 and extending the entire diameter of the half-section. The two sections are secured together so that their annular peripheral walls 216 abut at the same time that their central ribs abut and are aligned coaxially. The two half sections are arranged to be secured together by plural screws 220 extending through aligned threaded holes 222 in the two half sections. This arrangement produces a pair of semicircular shaped pockets 224 on opposite sides of the abutting central ribs 218 to effectively lessen the weight of the disk-like member 202. Each of the inner surfaces of the abutting central ribs 218 includes a helical or spiral threaded recess 226, which when the two half-sections 202A and 202B are secured together conjoin to form a helically threaded passageway 228 extending from the peripheral sidewall along substantially the entire length of the central ribs.

The drive shaft 204 is arranged to be located within the helical threaded passageway 228. To that end the drive shaft 204 basically comprises an elongated rod having an external helical thread extending about its periphery for mating engagement with the helical threaded passageway 228. The lower end of the drive shaft is in the form of a hub 242 that is fixedly mounted on the top wall of a rotary support member 240. The support member 240 is similar in construction to rotary support member 76 except that it has a pair of threaded holes (to be described later) for receipt of respective screws (to be described later). The cylindrical central hub 242 is secured to the top surface of the support member 240 coaxial with the axis of rotation of the support member 240, i.e., coaxial with the rotation shaft 74. The rod is secured to the support member 240 by a pair of screws 244 (FIG. 16) extending through respective holes 246 in the hub 242. The support member 240 is arranged to be rotated either clockwise or counter-clockwise by the motor 206, depending upon the direction of rotation of its output shaft 74.

The direction of rotation of the motor is established by which of the two trigger buttons 210 and 212 is depressed. In particular, when button 210 is depressed the motor 206 will rotate in one, e.g., clockwise, direction, whereupon the shaft is also rotated clockwise. When the button 212 is depressed, the motor 206 will rotate in the opposite, e.g., counterclockwise direction.

Figure 17:
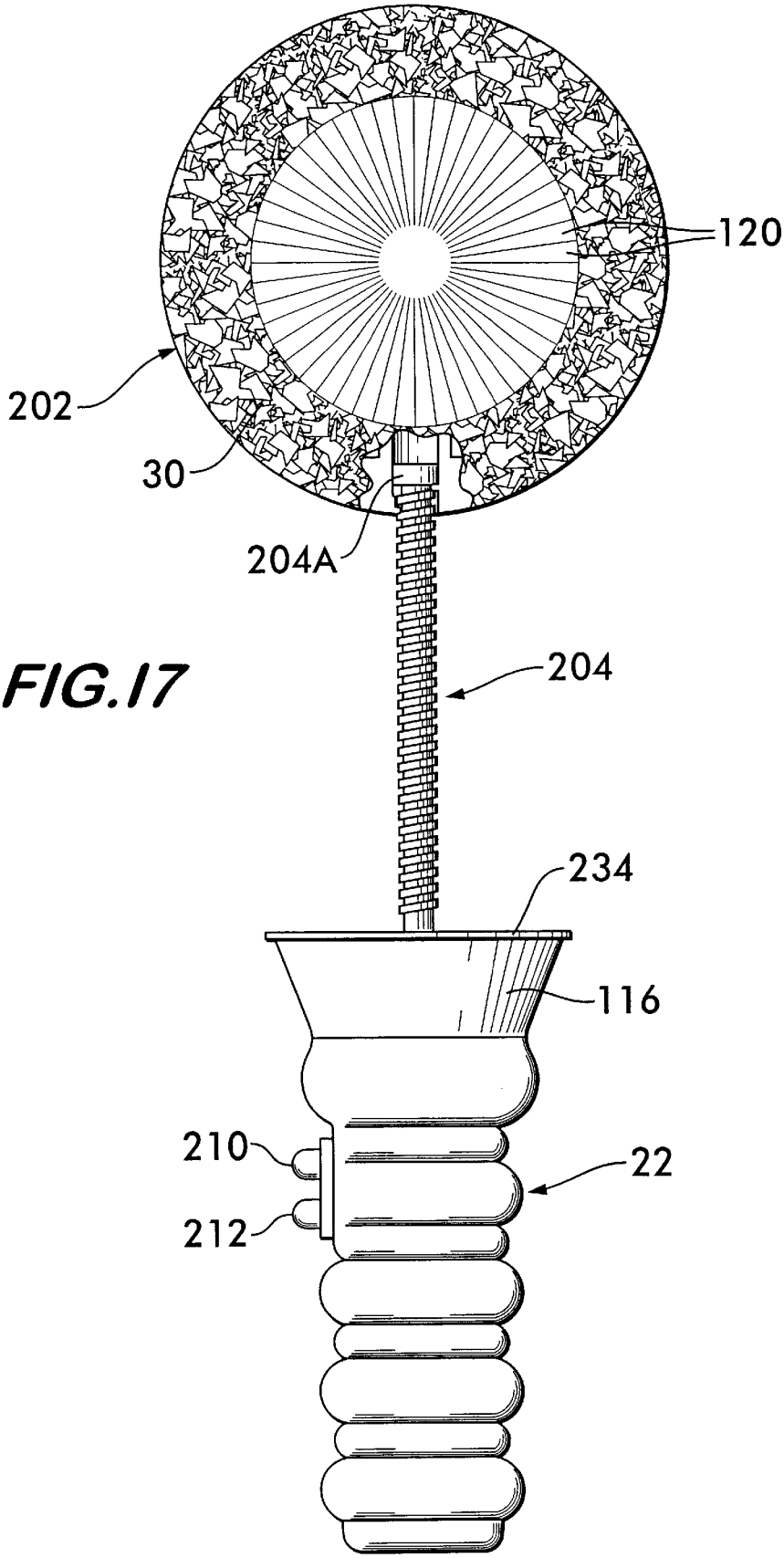
FIG. 17 is a side elevational view of the embodiment of FIG. 14, but with its rotatable member shown in its levitated position.

The inertia of the plate-like member 202 coupled with the clockwise rotation of the shaft 204 within the threaded passageway or bore 228 causes the plate-like member 202 to begin rotation with the shaft and relative to the shaft, whereupon the member 202 moves up the shaft until the free end of the shaft, which includes a stop 204 attached to it, engages the bottom of the threaded passageway 228. Thus, upon depression of the trigger button 210 the plate-like member 202 will climb up the drive shaft, thereby appearing to levitate above the handle 34 as shown in FIG. 17. At the same time the disk-like member 202 is rotating the illumination assembly 208 is operating to illuminate that member.

Accordingly, the operation of the toy by depression of the trigger button 210 causes the disk-like member to rotate and be illuminated to thereby create an illusion of a levitating globe or sphere illuminated from within.

Once the disk-like member 202 reaches the top of the drive shaft 204 (FIG. 17) it will remain rotating in that position until it is brought back toward the handle 34. The descent of the rotating disk-like member 202 toward the handle 34 is achieved by depressing the other trigger button 212. This action has the effect of causing the motor 206 to begin to rotate in the opposite (counterclockwise) direction, whereupon the interaction of the threads on the drive shaft and the threads on the passageway cause the plate-like member 202 to move down the shaft until it is in the fully retracted or lowermost position shown in FIG. 14. It will remain rotating in that position so long as the trigger button 212 remains depressed.

The stationary illumination assembly 208 basically comprises a plurality of, e.g., four, lamps 78A–78D which are fixedly mounted on a flanged annular wall 230 of the handle assembly. The flanged annular wall 230 extends inward from the bottom of the flared sidewall 216 of the handle assembly 22. The lamps 78A–78D are electrically connected via respective conductors 232 to a pair of connection boxes (to be described later) so that all of the lamps receive electrical power from the battery pack 50 when either of the trigger buttons 210 or 212 is depressed. Thus, whenever either of the trigger buttons is depressed electrical energy is provided to the lamps to illuminate them. A transparent or translucent annular disk 234 is mounted on the top rim of the flared sidewall 216 to enable illumination from the lamps to pass therethrough to reach to rotatable plate-like member 202 to illuminate the holographic refractive surfaces thereof as the member 202 rotates.

The trigger buttons 210 and 212 are mounted on the handle assembly 22. Each trigger button is a spring loaded device and includes a movable electrical contact. In particular, trigger button 210 includes a movable electrical contact 250. The movable contact 250 is biased to be spaced from a fixed electrically conductive contact plate 252 by a helical compression spring 254. The spring 254 is electrically connected to ground via a conductor 256 and is in electrical continuity with the movable contact 250. Thus, the movable contact 250 is also connected to ground. The fixed contact plate 252 is connected to the fixed contact 100 which serves as the negative pole of the battery pack 50. The contact 100 is also electrically connected via a conductor 258 to one input of a connection box 260 and to one pole or input of the reversible motor 206. The other input to the connection box 260 is provided via an electrical conductor 262. The conductor 262 is connected to the contact 96 that forms the positive pole of the battery pack 50. The connection box 260 includes four electrical output conductors 232. These conductors are connected to the lamps 78A–78D.

In a similar manner, the trigger button 212 also includes a movable electrical contact 264. The movable contact 264 is biased to be spaced from a fixed electrically conductive contact plate 266 by another helical compression spring 254. This second spring 254 is also electrically connected to ground via another conductor 256 and is in electrical continuity with the movable contact 264. Thus, the movable contact 264 is also connected to ground. The fixed contact plate 266 is connected to the fixed contact 96 which serves as the positive pole of the battery pack 50. The contact plate 96 is also connected via a conductor (not shown) to one input (not shown) of another connection box 268 and to the other pole of the reversible motor 206. The other input to the connection box 268 is provided by a conductor (not shown) to the contact 100 that serves as the negative pole of the battery pack 50. The connection box 268 includes four output conductors 232 which are also connected to the lamps 78A–78D.

As should be appreciated from the foregoing, when the trigger 210 is depressed the electrical engagement of the fixed contact plate 252 by the movable contact 250 grounds the connector box 260 and completes a circuit providing electric power to all the lamps, while also causing the motor to commence rotation in one rotational direction. This causes the plate-like member 202 bearing the holographic diffraction surfaces to begin to spin and to rise from the lowermost position adjacent the handle assembly as shown in FIG. 14 to reach the highest or elevated position shown in FIG. 17 where it continues to rotate. Conversely, when the trigger 212 is depressed the electrical engagement of the movable contact 264 with the fixed contact plate 266 grounds that contact plate, thereby reversing the polarity on the motor 206, whereupon the motor commences rotation in the opposite direction, thereby causing the plate-like member 202 to descend towards the handle assembly. At the same time electric power to all of the lamps is provided via the conductors 232 from the connection box 266.

It should be noted that toys constructed in accordance with this invention can make use of various features from the disclosed embodiments. By way of example, but not limitation, a toy can be constructed which makes use of the combination of a rotary light source such as the light source mechanism of the embodiment of FIG. 1 and a stationary light source, such as the light source mechanism of the embodiment of FIG. 14. Moreover, any type of light emitting device can be used for the light source. Further still, all or any portion of the surface of the rotating plate-like member can itself be in the form of a holographic diffraction surface, instead of having a holographic diffraction film secured to it. Further still other types of hologram producing surfaces can be used in lieu of a holographic diffraction surface.

Without further elaboration, the foregoing will so fully illustrate our invention that others may, by applying current or future knowledge, readily adapt the same for use under various conditions of service.

We claim:

1. A toy for producing a three dimensional aesthetically pleasing image, said toy comprising a handle, a source of illumination, a rotary drive mechanism, and a plate-like member, said plate-like member being rotatable about an axis and having an exterior holographic diffraction surface, said handle being arranged to be held in the hand of a user and holding said rotary drive mechanism therein, said rotary drive mechanism comprising an electrical power source, an electrical switch and an electrically operated motor, said motor being coupled to said power source, said switch and to said plate-like member, whereupon actuation of said switch causes electrical power provided from said power source to said motor to cause said motor rapidly rotate said plate-like member about said axis, whereupon light received by said holographic diffraction surface of said rotating plate-like member produces an aesthetically pleasing illuminated three dimensional image.

2. The toy of claim 1 wherein the light to produce said three dimensional image is provided by ambient light.

3. The toy of claim 1 wherein the light to produce said three dimensional image is provided by illumination of said source of illumination.

4. The toy of claim 1 wherein said plate-like member is has a regular geometrical profile.

5. The toy of claim 1 wherein said regular geometrical profile is circular.

6. The toy of claim 1 wherein said rotating plate-like member is mounted on a shaft, said shaft being coupled to said motor for rotation about said longitudinal axis in one rotational direction, said rotating plate-like member being coupled to said shaft and arranged to move along said longitudinal axis with respect to said handle upon the rotation of said shaft in said one rotational direction, whereupon said rotating plate-like member moves away from said handle to appears to levitate with respect to said handle.

7. The toy of claim 6 wherein said shaft includes a helically pitched thread extending along at least a portion of said shaft, and wherein said rotating plate-like member includes a mating shaped helically pitched track for receipt of said helically pitch thread.

8. The toy of claim 7 wherein said plate-like member comprises a pair of planar members secured together and defining a threaded passageway therebetween into which said shaft extends.

9. The toy of claim 6 wherein said shaft is arranged to rotate in a second rotational direction, opposite to said first rotational direction, whereupon said rotating plate-like member moves towards said handle.

10. The toy of claim 9 wherein said electrically operative motor is reversible to cause said shaft to rotate in either of said two opposite rotational directions, said shaft when rotating in one of said two opposite rotational directions causing said plate-like member to move away from said handle assembly, and when rotating in the other of said two opposite rotational directions causing said plate-like member to move towards said handle assembly.

11. The toy of claim 10 wherein the light to produce said three dimensional image is provided by the illumination of said source of illumination.

12. The toy of claim 11 wherein said source of illumination is provided with electrical power to cause it to illuminate whenever said motor is operated.

13. The toy of claim 3 wherein said source of illumination is provided with electrical power to cause it to illuminate whenever said motor is operated.

14. The toy of claim 12 wherein said source of illumination comprises at least one lamp or LED.

15. The toy of claim 13 wherein said source of illumination comprises at least one lamp or LED.

16. The toy of claim 14 wherein said lamp or LED is fixedly mounted with respect to said handle assembly.

17. The toy of claim 15 wherein said lamp or LED is fixedly mounted with respect to said handle assembly.

18. The toy of claim 14 wherein said lamp or LED is movably mounted with respect to said handle assembly so as to rotate with said plate-like member.

19. The toy of claim 15 wherein said lamp or LED is movably mounted with respect to said handle assembly so as to rotate with said plate-like member.

20. The toy of claim 1 wherein said rotating plate like member has an opening therein, said toy also including a spherical member mounted within said opening.

21. The toy of claim 20 wherein said spherical member includes an aesthetically pleasing object therein for viewing through said spherical member.

22. The toy of claim 21 wherein said aesthetically pleasing object is three dimensional.

23. The toy of claim 3 wherein said source of illumination comprises at least one light emitting device.

24. The toy of claim 23 wherein said at least light emitting device comprises a lamp or LED, said lamp or LED being stationarily mounted with respect to said handle.

25. The toy of claim 24 additionally comprising a reflector mounted on said handle for directing the light produced by said at least one lamp or LED towards said rotating plate-like member.

26. The toy of claim 23 wherein said at least one light emitting device is arranged to be rotated with said plate-like member.

27. The toy of claim 23 wherein said toy includes at least two light emitting devices, one of said light emitting devices being stationarily mounted with respect to said handle and the other of said light emitting devices being rotatably mounted with respect to said handle.

28. The toy of claim 17 wherein each of said light emitting devices comprises at least one lamp or LED.

* * * * *